US007525500B2

(12) United States Patent
Lee

(10) Patent No.: US 7,525,500 B2
(45) Date of Patent: Apr. 28, 2009

(54) ELEMENT REDUCTION IN PHASED ARRAYS WITH CLADDING

(75) Inventor: Gregory S Lee, Mountain View, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 377 days.

(21) Appl. No.: 11/551,382

(22) Filed: Oct. 20, 2006

(65) Prior Publication Data

US 2008/0094300 A1 Apr. 24, 2008

(51) Int. Cl.
*H01Q 21/00* (2006.01)

(52) U.S. Cl. ..... 343/771; 343/844; 343/873

(58) Field of Classification Search ..... 343/754, 343/770, 771, 844, 873, 909
See application file for complete search history.

(56) References Cited

U.S. PATENT DOCUMENTS 6,774,867 B2 * 8/2004 Diaz et al. ..... 343/909
6,952,190 B2 * 10/2005 Lynch et al. ..... 343/909

* cited by examiner

*Primary Examiner*—Michael C Wimer

(57) ABSTRACT

Grating lobe free scanning in a phased array with sparse element spacing is obtained by restricting the maximum scan angle for elements in the array, and cladding the array. Array elements may be integrated into the cladding.

20 Claims, 6 Drawing Sheets

ELEMENT REDUCTION IN PHASED ARRAYS WITH CLADDING

CROSS-REFERENCE TO RELATED APPLICATIONS

This application is related by subject matter to U.S. application for patent Ser. No. 10/997,422, entitled "A Device for Reflecting Electromagnetic Radiation," U.S. application for patent Ser. No. 10/997,583, entitled "Broadband Binary Phased Antenna," both of which were filed on Nov. 24, 2004, and U.S. Pat. No. 6,965,340, entitled "System and Method for Security Inspection Using Microwave Imaging," which issued on Nov. 15, 2005.

This application is further related by subject matter to U.S. application for patent Ser. No. 11/088,536, entitled "System and Method for Efficient, High-Resolution Microwave Imaging Using Complementary Transmit and Receive Beam Patterns," U.S. application for patent Ser. No. 11/088,831, entitled "System and Method for Inspecting Transportable Items Using Microwave Imaging," U.S. application for patent Ser. No. 11/089,298, entitled "System and Method for Pattern Design in Microwave Programmable Arrays," U.S. application for patent Ser. No. 11/088,610, entitled "System and Method for Microwave Imaging Using an Interleaved Pattern in a Programmable Reflector Array," and U.S. application for patent Ser. No. 11/088,830, entitled "System and Method for Minimizing Background Noise in a Microwave Image Using a Programmable Reflector Array" all of which were filed on Mar. 24, 2005.

This application is further related by subject matter to U.S. application for patent Ser. No. 11/181,111, entitled "System and Method for Microwave Imaging with Suppressed Sidelobes Using Sparse Antenna Array," which was filed on Jul. 14, 2005, U.S. application for patent Ser. No. 11/147,899, entitled "System and Method for Microwave Imaging Using Programmable Transmission Array," which was filed on Jun. 8, 2005 and U.S. application for patent Ser. No. 11/522,193entitled "Convex Mount for Element Reduction in Phased Arrays with Reduced Scan" filed on Oct. 20, 2006.

TECHNICAL FIELD

Embodiments in accordance with the present invention relate to phased arrays, and in particular to sparse phased arrays.

BACKGROUND

Phased arrays, in ultrasonic applications and from the RF to the visible end of the electromagnetic spectrum, provide beam steering with no moving parts. Electronic control replaces mechanical control, which is a tremendous advantage in terms of speed and maintenance. Unfortunately, these advantages are often offset by a cost disadvantage. The number of electronic elements in a circular array is on the order of $\pi(D/\lambda)^2$, where D is the diameter of the circular array and $\lambda$ is the operating wavelength. This comes about as the standard rule is to space antenna elements apart by $\lambda/2$ in both directions to suppress sidelobes throughout a hemispherical scan.

In most traditional phased arrays, the control devices are expensive, and in some cases each may require one or more stages of amplification. Even when the active devices are relatively inexpensive, the overall phased array system may require a very deep digital memory to support a large set of focal areas or volumes.

In order to bring the cost down, it is attractive to reduce the number of antenna elements making up the array, thereby reducing the number of control devices, as well as the width of the supporting driver memory.

Simply omitting elements from an originally dense phased array produces a so-called sparse array. Sparse arrays are well known in the ultrasound and microwave/millimeter wave literature to create new problems, particularly the appearance of so called grating sidelobes. That is, in addition to the desired main scanning lobe, there are additional high-level lobes created at different angles. These sidelobes contribute ghosting phenomena to the scanned or imaging process.

Various post-processing remedies have been tried. For example, deconvolution algorithms can be applied, but the most successful of these are nonlinear algorithms which are both scene dependent and very time consuming. Two of the most popular deconvolution algorithms are CLEAN (ref) and Maximal Entropy Method, or MEM (ref). An older, linear (and hence faster and more general) approach is Wiener-Helstrom filtering (ref), but it is well known in that it produces inferior image reconstruction compared to the nonlinear approaches (which are slower and more specialized) such as Maximum Likelihood (ML) iteration (ref) Correlation imaging, involving different subsets of an already sparse array, is also a nonlinear scheme which tends to be quite slow, i.e., not suitable for real-time use. In some cases, such as radioastronomy, one has a priori knowledge of the scene (say, from visible telescopes) which can be used to weed out much of the ghost phenomena. Obviously, this "solution" is inadequate in dealing with a highly dynamic environment.

What is needed is a satisfactory real-time, scene-independent solution to the ghosting problem of reduced element (sparse) arrays.

SUMMARY OF THE INVENTION

Sidelobe-free scanning in a phased array with element spacing greater than $\lambda/2$ is accomplished by restricting maximum scan angles to less than $\pi/2$ radians and cladding the array with a metamaterial.

DETAILED DESCRIPTION OF THE EMBODIMENTS

In phased-array systems, the commonly stated requirement for $\lambda/2$ spacing between elements (where $\lambda$ is the operating wavelength) arises from the desire to minimize sidelobes when scanning at angles up to $\pi/2$ radians, or 90° from the scan center, which is a line normal to the plane of the array. Sparse arrays, where the element spacing is greater than $\lambda/2$ create grating sidelobes for large scan angles. While post-processing approaches to reduce the ghosting introduced by these sidelobes exist the better ones are computationally expensive and scene dependent, making them impractical in dynamic environments such as security scanning.

In prototypical phased array applications such as the Distant Early Warning (DEW) radar system, or AEGIS AN/SPY-1 phased array radars, wide scan angles, up to 2 $\pi$ steradians, are required. However, in many applications, a smaller solid angle scan field is sufficient. As an example, in security screening of individuals or objects, the scan solid angle is limited by body size or object size, and is far less than $2\pi$ steradians. Similarly, a systems designer may wish to have N phased arrays operating in parallel in order to increase throughput by a factor of N, i.e. looking at N bodies or targets in a given volume at the same time. In such a case the solid scan angle required of any given array in the system is roughly divided by N.

Figure 1:
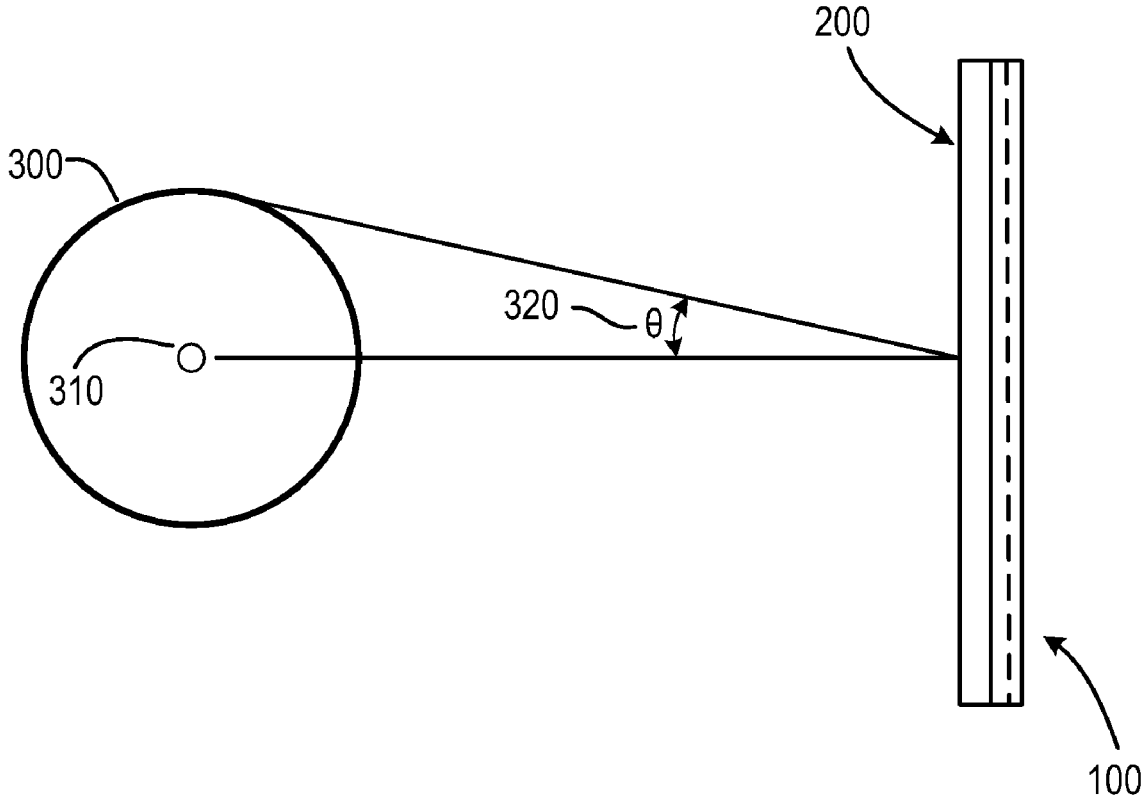
FIG. 1 shows a first system diagram.

A view of an embodiment of the present invention is shown in FIG. 1. Semi-sparse phased array 100 is covered with cladding 200. The combination of semi-sparse array 100 and cladding 200 provides for grating-sidelobe free scanning of scan zone 300. This scan zone is defined by scan center 310 and maximum scan angle 320.

In FIG. 1, array 100 can be either an ultrasonic or electromagnetic phased array, with cladding 200 whose phase velocity for sound or electromagnetic (whichever is relevant) waves significantly exceeds that of the propagation medium at the frequency of interest. For example, if one is propagating 1 MHz ultrasound through seawater then a "supersonic cladding" is defined to be a material or metamaterial for which the phase velocity of 1 MHz ultrasound in both directions along the plane of array 100 exceeds that of 1 MHz ultrasound in seawater. If one is propagating 300 THz light through vacuum then a "superluminal cladding" is defined to be a material or metamaterial for which the phase velocity of 300 THz light in both directions along the plane of the array exceeds $c=2.997925\times10^8$ m/s. Special relativity forbids such a speed violation for broadband signals; however, phase velocity and narrowband (resonant or nearly resonant) group and even energy velocities>c are allowed. What is never allowed is a superluminal front velocity, i.e., the leading edge of a square pulse may not exceed the speed of light in vacuum. As an example, if one is propagating microwaves through breast tissue to search for cancer, then air can function as the "superluminal cladding" since all microwave velocities in air significantly exceed their counterparts in fat or water, the primary constituents of breast tissue.

A metamaterial used for cladding 200 (sometimes called a photonic crystal) is a periodic, inhomogeneous structure which simulates a homogeneous material. Metamaterials have become popular in the research literature lately with particular regards to so-called left-handed or negative index of refraction materials. We note that the narrow frequency band for which left-handed or negative index behavior can be observed is always adjacent to one or two narrow frequency bands for which superluminal phase velocity occurs, so the metamaterials proposed in the left-handed materials literature can be used as our cladding simply by shifting the frequency. On the other hand, phase-superluminal materials exists which are nowhere left-handed, for example, plasmas and metal waveguides.

Let 1/n=the ratio of the phase velocity in cladding 200 to the phase velocity in the propagating medium. Note n<1 by assumption. In the case of light and the medium being vacuum, n is like the effective index of refraction of the metamaterial. The element spacing in array 100 can now be relaxed to $\lambda/2n$ ($>\lambda/2$) and so we achieve a density reduction of $1/n^2$. I.e., the relative density of the new array is $n^2$. As long as the maximum scan angle 320 denoted by $\theta_{max}$, i.e., the maximum required deflection from the center of the scan 310, satisfies $\sin(\theta_{max})\leqq n$ we are able to successfully complete the scan. This is just the familiar formula for the critical angle for total internal reflection (TIR). This criterion arises because if the element spacing is $\lambda/2n$, then one could scan $\pm\pi/2$ or in other words an entire hemisphere if the propagation medium were the same as the material/metamaterial. However, Snell's law of refraction says that $\sin(\theta_{pm})=n\sin(\theta_{mm})$, where pm stands for propagation medium and mm stands for material/metamaterial, and choosing $\theta_{mm}=\pi/2$ yields the result.

In some cases cladding 200 material or metamaterial may be anisotropic. In fact, most metamaterials are anisotropic. In such cases, we have two velocity ratios $n_1$ and $n_2$ corresponding to the two principal array directions. The element spacing of phased array 100 can then be $\lambda/2n_1$ in the first direction and $\lambda/2n_2$ in the second direction. The density reduction is $1/n_1n_2$. The maximum possible scanned solid angle is an ellipsoidal with $\sin(\theta_{1,max})=n_1$ and $\sin(\theta_{2,max})=n_2$, where $\theta_{1,max}$ and $\theta_{2,max}$ are the principal half-angles subtended by the ellipsoidal cone.

The phased array need not be planar. A convex array is disclosed, for example, in related application entitled "Convex Mount for Element Reduction in Phased Arrays with Reduced Scan," incorporated herein by reference. In a true far-field application of a phased array, e.g., satellite communication or searching for ICBM's, a planar array is entirely satisfactory since $\theta_{max}$ is the same for any element in the array. If the target is closer, such as in many security scenarios, $\theta_{max}$ is a somewhat ill-defined concept for a planar array since it varies with the location within the array. However, if we can be relatively certain of a mean target distance, then a parabolic surface restores the uniqueness of $\theta_{max}$. Maximum element reduction then occurs by choosing $n=\sin(\theta_{max})$. The relative element density becomes $\sin^2(\theta_{max})$.

Figure 2:
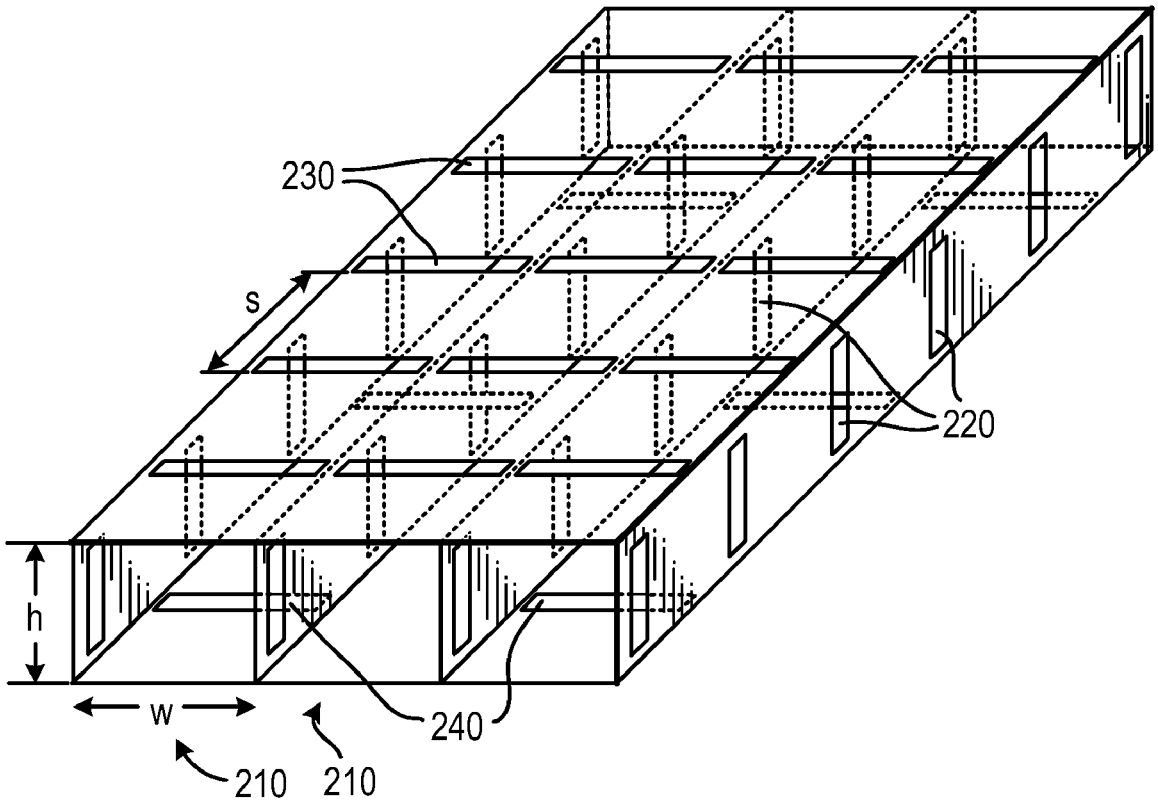
FIG. 2 shows a first diagram of a cladding material.

FIG. 2 shows an embodiment of cladding 200. This embodiment is anisotropic. In cladding 200 a group of side-by-side waveguides 210 are electromagnetically coupled to each other via slots 220 in their common sidewalls in addition, slots in the floor 240 and ceiling 230 provide electromagnetic coupling to the active array (not shown) below floor 240 and to the propagation medium (air or vacuum in this case) and target above ceiling 230, respectively. If the individual waveguide width w is chosen to be approximately $\lambda/2$ or slightly larger, then propagation along the long axis of the waveguides for waves polarized from floor to ceiling is nearly cutoff, a well-known condition for superluminal phase velocity. Likewise, if the floor-to-ceiling height h is approximately $\lambda/2$ or slightly larger, then propagation perpendicular to the walls in their absence for waves polarized parallel to the floor is also near cutoff, again phase-superluminal. For appropriately designed wall slots 220, the walls can be regarded as a perturbation upon this analysis. (Note that if we are willing to dispense with element reduction in one direction, namely along the long axis of the walls, then we can simply omit the walls.)

The slots, particularly ceiling slots 230, should be denser than the sparse array elements. One can think of ceiling slots 230 as secondary radiating elements so that the collection of ceiling slots 230 can be thought of as a secondary antenna array. Since this secondary array is adjacent to the propagation medium it should satisfy the usual density requirement, namely the element spacing should be close to $\lambda/2$. That is, $w\approx\lambda/2$ in FIG. 2. The extra number of ceiling slots 230 compared to the number of active elements can be thought of as interpolating radiators—they sample and average or interpolate the nearest neighbor active antennas. The wall slots 220 should also be spaced by $s\approx\lambda/2$. Floor slots 240 only need be in one to one correspondence with the active array elements. In an alternate embodiment, if the phased array antenna elements are embedded between the floor and the ceiling so that the metamaterial and the array are integrated, then floor slots 240 may be omitted.

Figure 3:
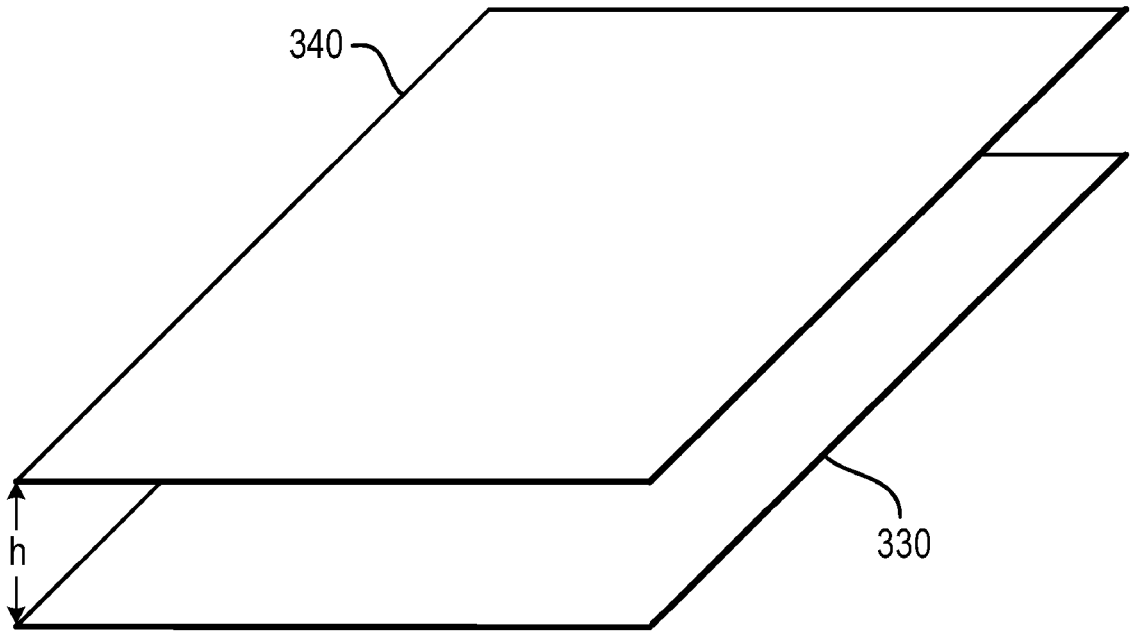
FIG. 3 shows a second diagram of a cladding material.

An implementation of a 2D-isotropic superluminal cladding is shown in FIG. 3. This consists of two parallel plane sheets separated by $h \approx \lambda/4$, one an electric conductor 310 (a metal) and the other a magnetic conductor 320. Due to the mixed boundary conditions and the height being barely greater than $\lambda/4$, both polarizations are near cutoff for both directions along the plane and no walls are needed. In order to couple to the propagation medium, slots (not shown) in the magnetic conductor ceiling 320 must be cut as in FIG. 2 and these will slightly break the isotropy. In order to couple to the array elements, either slots (not shown) in the conductor floor 310 must be cut as in FIG. 2, or the array elements can be integrated into the structure as discussed earlier. Alternatively, the slotted ceiling, coupled to the propagation medium, can be the electric conductor and the slotted floor, coupled to the array elements, can be the magnetic conductor. A suitable artificial magnetic conductor (AMC) is disclosed in U.S. Pat. No. 6,262,495, "Circuit and Method for Eliminating Surface Currents on Metals" to Yablonovitch et al., incorporated herein by reference An AMC is a metamaterial which is designed to provide a boundary condition at a given surface of zero tangential magnetic field in a given frequency band.

Figure 4:
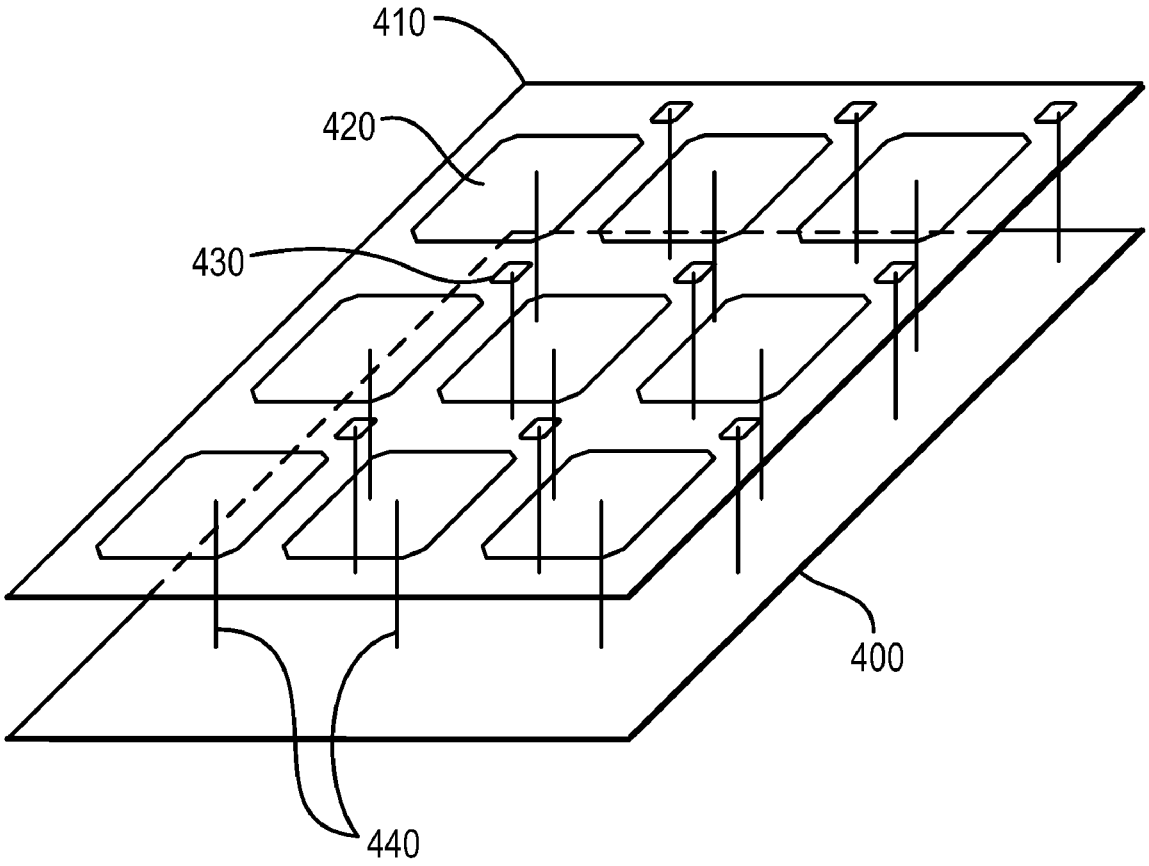
FIG. 4 shows a third diagram of a cladding material.

FIG. 4 shows an artificial magnetic conductor (AMC) as used in a compact antenna marketed by Etenna Corporation of Laurel Md. Electrical ground 400 is separated from AMC surface 410 by a dielectric. Alternating large patches 420 and small patches 430 are arrayed on AMC surface 410, forming a frequency selective surface. These capacitive patches 420 and 430 are connected to electrical ground 400 using ground vias 440.

There may be a significant fabrication advantage to the implementation of FIG. 3 over that of FIG. 2. If patch antennas are used as the radiating elements in the main phased array they already come with a ground plane which can serve as the floor (in either FIG. 2 or 3) so floor slots 240 of FIG. 2 can be omitted. However, in the case of FIG. 2, the sidewalls must be soldered to ground vias in the patch array printed circuit board (PCB) whereas the AMC ceiling implementation of FIG. 3 requires no soldering. One simply stands the AMC off the PCB the appropriate height and one is finished. Furthermore, if one wishes to tune the superluminal index of refraction n one can simply change the standoff h in FIG. 3 whereas in FIG. 2 one must start over and build new sidewalls.

Figure 5:
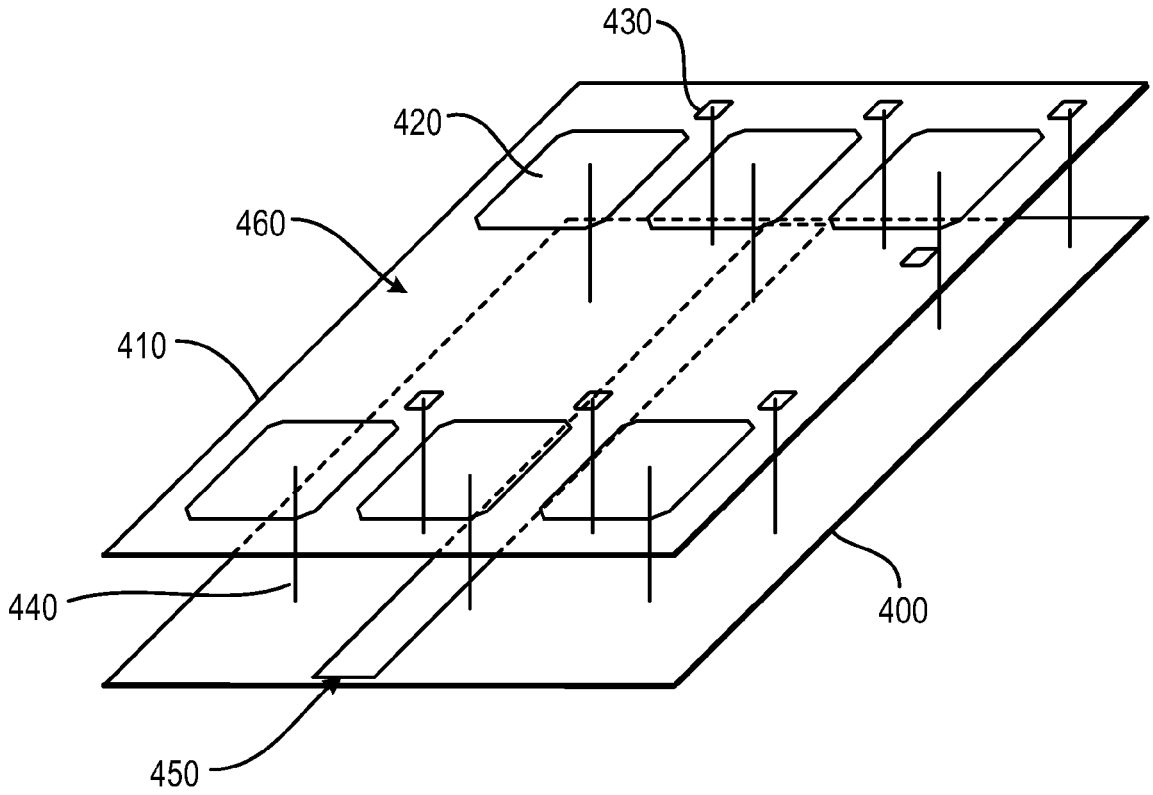
FIG. 5 shows a fourth diagram of a clad material.

Since the AMC is a metamaterial, we must be careful about what we mean by a slot in the AMC and show this in FIG. 5. As in FIG. 4, electrical ground 400 is separated from AMC surface 410 by a dielectric. Alternating large patches 420 and small patches are arrayed on AMC surface 410. These patches 420 and 430 are connected to electrical ground 400 using ground vias 440. In introducing slots into the AMC, we first carve out a slot 450 in electric conductor 400 which is behind the effective magnetic conducting surface. Second, there is an optional orthogonal missing row 460 of metal patches and associated ground vias. This missing row appears to go on forever in FIG. 5 but it is finite in length just as any radiating or coupling slot should be. It is orthogonal to the ground plane slot because electric and magnetic fields are orthogonal. It is optional because technically the metamaterial leaks or radiates once the ground plane is perforated.

To be completely general, an anti-reflection (AR) coating would be included in FIG. 1, but it is not shown. This AR coating would sit between the propagating medium and the supersonic/superluminal material/metamaterial. Typically this would be a quarter-wave film whose acoustic impedance/refractive index is the geometric mean of the medium and the material/metamaterial. Hence it too is typically supersonic/superluminal although less so than the primary cladding. In many instances this AR coating can be dispensed with since the metamaterial may be nearly impedance-matched to the medium in the narrow frequency band of interest due to oversimplification in the effective index model. For example, one typically needs both effective dielectric permittivity and effective magnetic permeability to completely describe a left-handed material so it is possible for a metamaterial to possess a superluminal phase velocity and yet still be impedance matched to free space. Or the impedance mismatch may be tolerable.

Figure 6:
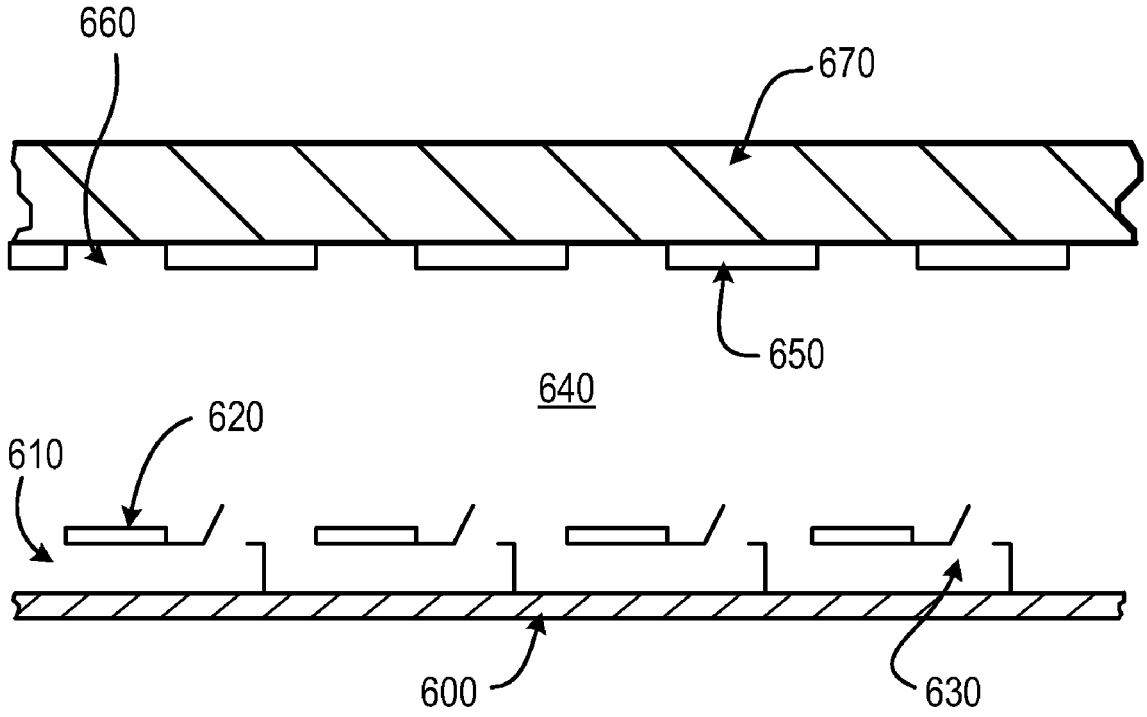
FIG. 6 shows a diagram of an array using cladding.

FIG. 6 shows an array cross section implementing the present invention. Ground plane 600 and dielectric 610 hold patch antennas 620. In the case of programmable reflectarray antenna, switches 630 connect the patches to ground 600. A second dielectric medium 640 such as air separates the patch array from artificial magnetic conductor (AMC) 650 serves as cladding. Materials previously described and shown in FIGS. 2 through 5 may also be used.

The principles of the present invention pertain equally to not only continuous-phase transmit or receive arrays, but also to other modalities such as reflectarrays, transmission (lens) arrays, binary phase arrays, and so on.

While the embodiments of the present invention have been illustrated in detail, it should be apparent that modifications and adaptations to these embodiments may occur to one skilled in the art without departing from the scope of the present invention as set forth in the following claims.

The invention claimed is:

1. A phased array antenna operating at a wavelength $\lambda$ in a predefined propagation medium comprising:

a plurality of antenna elements arranged into an array, the spacing between the antenna elements greater than $\lambda/2$ in at least one direction on the array, and a cladding material having a phase velocity at wavelength $\lambda$ greater than the propagation velocity in the predefined propagation medium, the cladding material covering the array.

2. The phased array antenna of claim 1 where the array is an active array.

3. The phased array antenna of claim 1 where the array is a passive array.

4. The phased array antenna of claim 3 where the array is a transmissive array.

5. The phased array antenna of claim 3 where the array is a reflector array.

6. The phased array antenna of claim 5 where the array is a passive programmable reflector array.

7. The phased array antenna of claim 1 where the array scans a solid angle less than $2\pi$ steradians.

8. The phased array of claim 1 where the element spacing is on the order of $\lambda/2n$ in at least one direction on the array, where the velocity ration 1/n is the ratio of the phase velocity in the cladding to the propagation velocity in the propagation medium.

9. The phased array of claim 8 where the cladding is isotropic and the element spacing is on the order of $\lambda/2n$ in two directions on the array.

10. The phased array of claim 8 where the cladding is anisotropic, having a first velocity ratio $n_1$ in a first array direction and a second velocity ratio $n_2$ in a second array direction, with an element spacing of $\lambda/2n_1$ in the first direction and an element spacing of $\lambda/2n_2$ in the second direction on the array.

11. The phased array of claim 1 where the array is planar.

12. The phased array of claim 1 where the array is convex.

13. The phased array of claim 1 where the away is piecewise-convex.

14. The phased array of claim 1 where the cladding comprises a group of side-by-side waveguides, each waveguide having sidewalls, a floor, and a ceiling, where the waveguides are coupled to each other via slots in their sidewalls, coupled to the phased array via slots in their floors, and to the propagation medium via slots in their ceilings.

15. The phased array of claim 14 where the density of ceiling slots is greater than the density of antenna elements in the array.

16. The phased array of claim 14 where the density of floor slots is on the same order as the density of antenna elements in the array.

17. The phased array of claim 1 where the cladding comprises a group of side-by-side waveguides, each waveguide having sidewalls, a floor, and a ceiling, where the waveguides are coupled to each other via slots in their sidewalls, to the propagation medium via slots in their ceilings, and the phased array elements are embedded between the floor and the ceiling.

18. The phased array antenna of claim 1 where the cladding is an artificial magnetic conductor spaced slightly greater than $\lambda/4$ from a conductive sheet, where the cladding is coupled to the propagation medium via slots in one of the artificial magnetic conductor or the conductive sheet.

19. The phased array antenna of claim 18 where the phased array is integrated into the ground plane of the artificial magnetic conductor.

20. The phased array antenna of claim 1 further including an antireflection coating between the cladding and the propagation medium.

* * * * *